US005803150A

United States Patent [19]

Boiteau

[11] Patent Number: 5,803,150

[45] Date of Patent: Sep. 8, 1998

[54] DEVICE FOR OPERATING A CLOSURE ELEMENT MOVING AT LEAST APPROXIMATELY VERTICALLY

[75] Inventor: Jean-Philippe Boiteau, Scionzier, France

[73] Assignee: Somfy, France

[21] Appl. No.: 730,365

[22] Filed: Oct. 15, 1996

[30] Foreign Application Priority Data

Oct. 30, 1995 [CH] Switzerland ..... 3066/95

[51] Int. Cl.[6] ..... E06B 9/72; E06B 9/62

[52] U.S. Cl. ..... 160/310; 160/8; 192/55.1

[58] Field of Search ..... 192/55.1, 56.1, 192/41 R, 45.1, 46; 464/30, 42, 46; 160/8, 291, 310, 323.1; 242/394.1

[56] References Cited

U.S. PATENT DOCUMENTS 4,615,371 10/1986 Clauss ..... 160/310 X
4,887,660 12/1989 Kraus ..... 160/310 X
5,105,871 4/1992 Baud et al. ..... 160/310

FOREIGN PATENT DOCUMENTS 2337809 8/1977 France .
3608988 9/1987 Germany .

*Primary Examiner*—Richard M. Lorence
*Attorney, Agent, or Firm*—Laff, Whitesel, Conte & Saret, Ltd.

[57] ABSTRACT

The operating device comprises a drive shaft (1) driven by a geared motor unit (4) via a transmission mechanism allowing the closure element being lowered to be disengaged when a resistive force opposes the lowering thereof. The device has no brake. By contrast, it comprises a spring (8) for compensating for the weight of the closure element and the transmission mechanism (6) consists of a friction coupling and, possibly, of a one-way coupling mechanism.

The absence of a brake and the weight compensation make it possible for the closure element to be raised easily and quickly by hand in an emergency, while the friction coupling allows the closure element to be driven downward by the motor.

3 Claims, 1 Drawing Sheet

Fig.1
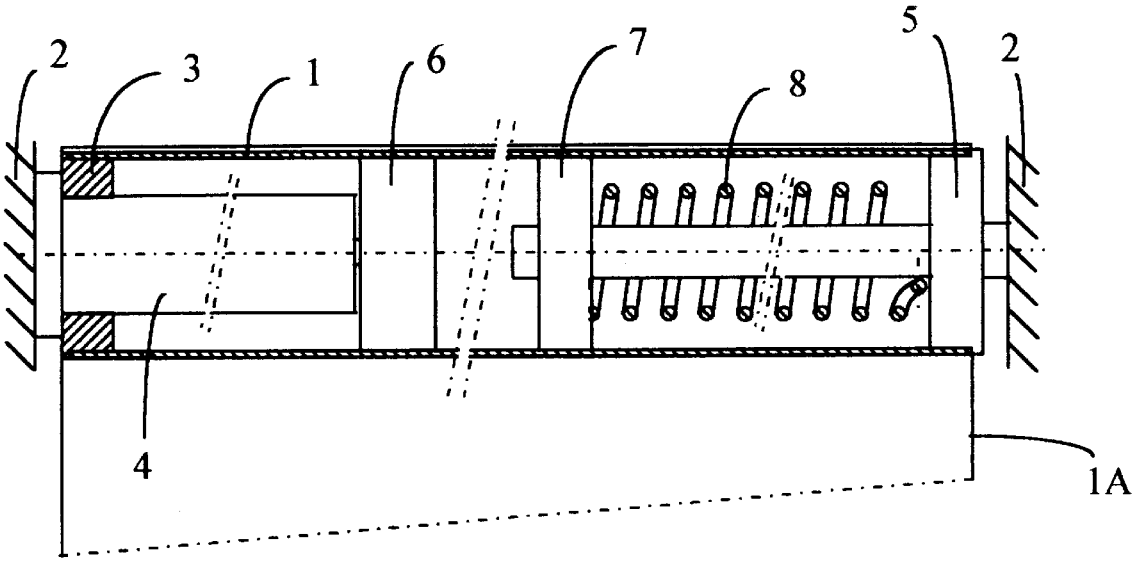
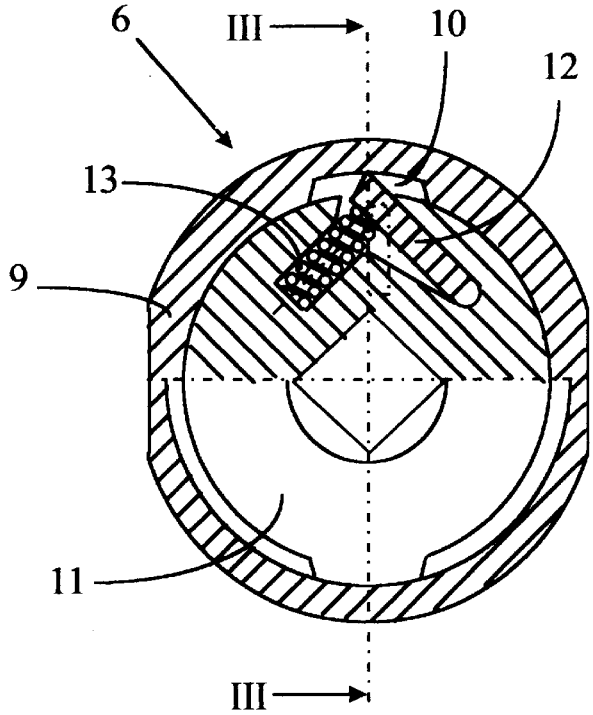
Fig.2
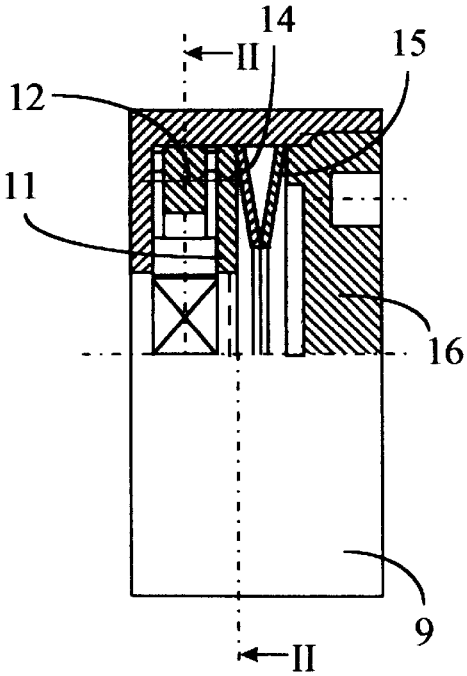
Fig.3

DEVICE FOR OPERATING A CLOSURE ELEMENT MOVING AT LEAST APPROXIMATELY VERTICALLY

FIELD OF THE INVENTION

The invention relates to a device for operating a closure element which moves at least approximately vertically, comprising a motor, reduction gearing, a drive shaft for the closure element and a transmission mechanism between the reduction gearing and the drive shaft, this transmission mechanism allowing the closure element being lowered to be disengaged when a resistive force opposes the lowering thereof.

PRIOR ART

Such a device is known especially from patent application DE 36 08 988. The transmission mechanism is a one-way coupling of the freewheel type allowing the closure element to be driven upward. This device is further equipped with a manual control allowing the closure element to be driven, particularly allowing a roller shutter to be opened in the event of the motor breaking down, for example during a power cut. This manual control comprises a worm and wheel transmission, that is to say a transmission which has a large step-down ratio. Such a manual control does not allow the closure element to be opened quickly in an emergency. Also known are devices of the same kind in which a special emergency control mechanism is provided. This control does not allow quick opening either, because the weight of the closure element means that the mechanism has to have a step-down ratio.

Moreover, drive devices are known which are equipped with a disengageable brake and comprise a spring for compensating for the weight of the closure element. To allow quick manual opening of the closure element, thoughts first of all were turned to equipping such a device with a one-way drive mechanism. This does not, however, allow the problem of security to be solved satisfactorily. This is because since the drive shaft is generally overcompensated in order to make raising the closure element easier, it is no longer possible to lower it electrically, the one-way transmission being incapable of providing the closure element with the force necessary to overcome the effect of the overcompensation.

SUMMARY OF THE INVENTION

The object of the invention is to produce, using simple means, a device for operating a closure element with electric motor capable of being opened very quickly by hand.

The device according to the invention is characterized in that it comprises elastic means for compensating for the weight of the closure element and in that the transmission mechanism at least consists of a friction coupling.

It should be emphasized that the device according to the invention has no brake, which makes it possible to avoid the system for disengaging the brake.

A one-way coupling may be associated with the friction coupling in such a way that during raising, the drive shaft is driven by the one-way coupling mechanism, whereas, during lowering, drive is provided by the friction coupling.

The presence of a friction coupling makes it possible to have less precise compensation for the weight of the closure element. The drive is less sensitive to variations caused by aging of the installation, as well as to wear of its constituent parts.

Manual drive of the closure element may be achieved either by acting directly on this closure element or, where possible, by acting directly on its drive shaft.

BRIEF DESCRIPTION OF THE DRAWINGS

The attached drawing represents, by way of example, one embodiment of the invention.

FIG. 1 is a view in axial section of a drive device for a roller shutter.

FIG. 2 is a view in section and in half section on II—II of FIG. 3 of the transmission mechanism 6 of FIG. 1.

FIG. 3 is a view in axial half section on III—III of FIG. 2 of the transmission mechanism.

DESCRIPTION OF THE PREFERRED EMBODIMENT

FIG. 1 represents a winding tube 1 for a roller shutter 1*a* mounted in a window reveal 2. At its left-hand end, the winding tube 1 is supported by a rolling bearing 3 itself supported by a geared motor unit 4 mounted inside the winding tube 1 and fixed to the reveal 2. At its other end, the winding tube 1 is mounted so that it can rotate on a disk 5 which is stationary in terms of rotation inside the reveal 2. The geared motor unit 4 drives the winding tube via a transmission device 6.

The winding tube 1 is furthermore integral in terms of rotation with a disk 7 connected to the stationary disk 5 by a helical spring 8 which works in torsion so as to compensate for the weight of the roller shutter as it is unrolled.

The transmission device 6 is represented in FIGS. 2 and 3. It comprises an annulus 9 integral in terms of rotation with the winding tube 1 and internally having two opposed notches 10 and a disk 11 integral in terms of rotation with the output shaft of the geared motor unit 4. This disk 11 is equipped, in a way which is, in itself, known, with two pawls 12 mounted respectively on a spring 13 and interacting with the notches 10 of the annulus 9 in order to provide one-way driving of the winding tube 1 in the direction of rolling up the roller shutter.

The transmission device 6 further comprises a friction coupling housed inside the annulus 9. This friction coupling consists of a pair of frustoconical steel washers 14 and 15 compressed between the disk 11 and a threaded flange 16 screwed into the annulus 9 in such a way that it is integral in terms of rotation with the annulus 9.

During raising, rolling-up is achieved via the one-way coupling. During lowering, if the roller shutter encounters an obstacle, the motor can continue to turn without driving the winding tube 1 and the friction coupling slips. In normal lowering, the motor drives the winding tube 1 via the friction coupling.

In the event of an electrical breakdown, the roller shutter can be rolled up by hand by raising the roller shutter directly. This operation is easy owing to the absence of a brake and to the compensation for the weight of the roller shutter.

In a simplified embodiment, the one-way coupling is omitted. In this case, the friction coupling plays a part both in raising and in lowering. Safety in the event of an obstacle encountered during raising is also provided because in such a case the friction coupling can slip as it does in lowering.

The device can be equipped with a lock activated by hand or automatically when the roller shutter is closed so as to prevent unauthorized opening and provide security against a break-in.

The device according to the invention is applicable to all closure elements moving vertically or obliquely.

I claim:

1. In combination with a closure element which moves approximately vertically, a device for operating the closure element comprising:

a motor (4);

reduction gearing coupled to said motor (4);

a transmission mechanism (6) coupled to said reduction gearing;

a drive shaft coupled to said transmission mechanism, said transmission mechanism between the reduction gearing and the drive shaft;

said closure element coupled to said drive shaft;

said transmission mechanism having a friction coupling, said friction coupling for driving said drive shaft in a lowering direction to lower said closure element, said friction coupling having a minimal frictional force to allow a lowering of said closure element to be disengaged when a resistive force opposes said lowering;

elastic means coupled to said drive shaft, said elastic means providing a force opposing a rotation of said drive shaft in said lowering direction, said force increasing as said drive shaft is rotated in said lowering direction, said elastic means compensating for the weight of the closure element.

2. In combination with a closure element which moves approximately vertically a device for operating the closure element comprising:

said closure element;

a motor (4);

reduction gearing (4);

a drive shaft (1) for the closure element;

an elastic means (8) for compensating for the weight of the closure element; and a transmission mechanism having a one-way coupling mechanism and a friction coupling (9, 12), said transmission mechanism between the reduction gearing and the drive shaft, the transmission mechanism allowing the closure element being lowered to be disengaged when a resistive force opposes the lowering thereof.

3. The combination as claimed in claim 2, in which the one-way coupling mechanism consists of a disk (11) integral with the output shaft of the reduction gearing and equipped with pawls (12) interacting with notches (10) of an annulus (9) integral with the drive shaft (1) for the closure element, wherein the friction coupling (11, 14, 15, 16) is housed inside said annulus (9) and provides friction coupling between the disk (11) of the one-way coupling and a flange (16) integral in terms of rotation with the annulus (9).

* * * * *